United States Patent [19]

Arai et al.

[11] 3,944,969

[45] Mar. 16, 1976

[54] CENTRAL WARNING APPARATUS FOR VEHICLES

[75] Inventors: Hiroshi Arai, Toyota; Yohei Watanabe, Okazaki; Jun Ohta; Nobumasa Higo, both of Toyota; Yasuhiko Sakurai, Kariya, all of Japan

[73] Assignees: Nippondenso Co., Ltd., Kariya; Toyota Jidosha Kogyo Kabushiki Kaisha, Toyota, both of Japan

[22] Filed: Oct. 16, 1973

[21] Appl. No.: 406,861

[30] Foreign Application Priority Data

Oct. 18, 1972 Japan ..... 47-104806

[52] U.S. Cl. ..... 340/52 F; 307/10 R; 340/411

[51] Int. Cl.[2] ..... G08B 19/00

[58] Field of Search ..... 340/52 R, 52 F, 27 R, 411, 340/412, 414, 415; 307/10 R; 180/103 A

[56] References Cited

UNITED STATES PATENTS

| | | | |
|---|---|---|---|
| 2,934,752 | 4/1960 | Arrasmith | 340/27 R |
| 3,541,550 | 11/1970 | Hamre | 340/52 F |
| 3,550,121 | 12/1970 | Porter | 340/415 |
| 3,566,401 | 2/1971 | Smith et al. | 340/411 |
| 3,660,814 | 5/1972 | Fales | 340/52 F |
| 3,711,827 | 1/1973 | Houseman | 340/52 F |

*Primary Examiner*—John W. Caldwell
*Assistant Examiner*—Joseph E. Nowicki
*Attorney, Agent, or Firm*—Cushman, Darby & Cushman

[57] ABSTRACT

A central warning apparatus for vehicles which comprises a plurality of sensors mounted to the plurality of portions of vehicle to be inspected, discriminator circuits for discriminating an abnormal state of the sensors, display units connected to the discriminator circuits so as to be effected in response to the abnormal state, an OR-gate circuit connected to the output of respective discriminator circuits, and a main warning unit connected to the OR-gate circuit so as to be effected by an output therefrom for warning that there arises an abnormal state at at least one of portions to be inspected.

11 Claims, 8 Drawing Figures

CENTRAL WARNING APPARATUS FOR VEHICLES

This invention relates to a central warning apparatus for vehicles, particularly for automobiles in which prior to the running of vehicle or during the running thereof, parts and functions responsible for safety operation of vehicle are inspected of their normality and the result is centrally displayed with a single unit for giving warning.

Conventionally, for safety running of automobile, independent or separate display units are provided for a plurality of portions responsible for the safety running which indicate whether or not these portions act normally. However, in case that the number of portions to be inspected is considerably increased, even when an indication representative of the abnormal state is presented, a driver sometimes tends to overlook it.

To eliminate such drawbacks, this invention contemplates a central warning apparatus in which there are provided sensors mounted to a plurality of portions to be inspected, display units and main warning unit located respectively at places observable from a driver seat, wherein discriminator circuits which receive a sensed signal from corresponding sensors actuate corresponding display units and at the same time the main warning unit as well through an OR-gate circuit when the sensed signal is discriminated as an abnormal signal which exceeds a predetermined value.

Accordingly, the principal object of this invention is to provide a novel central warning apparatus for vehicles of a simple construction capable of instantly warning a driver of a portion or portions abnormally inspected.

Another object of this invention is to provide a fail-safe central warning apparatus for vehicles capable of readily checking for the operation by itself.

According to this invention, a central warning apparatus for vehicles comprises sensors mounted to portions of a vehicle to be inspected for converting a sensed physical quantity into an electric signal; discriminator circuits electrically connected to the sensors for producing an output signal when the sensor generates an electric signal responsive to discrimination of an abnormal state of the portion to be inspected; display units electrically connected to the discriminator circuits for indicating abnormality of the portion to be inspected by means of the output signal of the discriminator circuits; an OR-gate circuit whose input terminal is connected to an output terminal of respective discriminator circuits included in an abnormal state display circuit provided for the plurality of portions to be inspected corresponding thereto, the abnormal state display circuits each including an electrical connection of the sensor, the discriminator circuit and the display unit; a main warning unit electrically connected to the OR-gate circuit for warning in response to an output signal from the OR-gate circuit that there arises an abnormality at at least one of portions to be inspected; and a checking unit for checking the operational state of the abnormal state display circuits and a circuit of the main warning unit by selectively connecting a power source with them.

Other objects, features and advantages of this invention will fully be understood from the following detailed description taken in conjunctions with the accompanying drawings in which.

Figure 1:
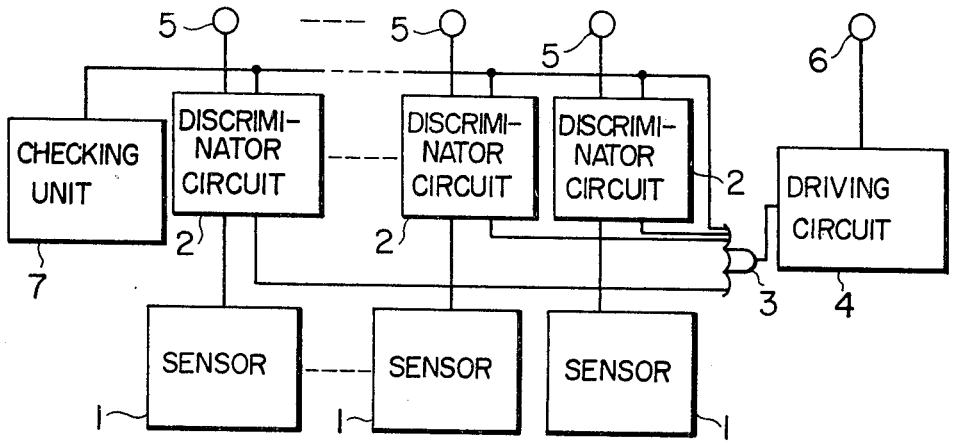
FIG. 1 is a schematic block diagram of a central warning apparatus of the invention.

Referring now to FIG. 1 in which solid lines interconnecting blocks are signed lines and power source lines are omitted, a general constitution and function of the central warning apparatus will be described. In the figure, numeral 1 designates sensors mounted to portions of vehicle to be inspected for detecting an abnormal or disordered state of the portions, for example liquid gauge sensors mounted to the oil reserver of brake master cylinder for checking the quantity of brake oil. Essentially, since one sensor is required for one portion to be inspected, the same number of sensors as the portions to be inspected are used. Numeral 2 designates discriminator circuits each receiving an output signal from the sensor 1 for discriminating the state of portion to be inspected so as to effect a corresponding display unit 5. The display unit 5 may take the form of an optical mechanism structure, for example a lamp or luminous element, or an acoustic mechanism structure such as a buzzer but the former is preferable. The discriminator circuit 2 also serves to deliver a signal regarding abnormal state of the portion to be inspected to an OR-gate circuit 3 and it essentially constitutes a set of circuits together with the sensor 1 and display unit 5. Numeral 4 designates a driving circuit for effecting a main warning unit 6. The display units 5 such as lamps are checked by a driver only when the portions to be inspected turn abnormal. Accordingly, in view of the frequency of checking, it is not always necessary for the display units to be located at places observable from the driver. Further, it is difficult to make room for the display unit within a limited interior space of automobile as the number of the portions to be inspected gets greater. To solve such problems, the main warning unit 6 is employed. The main warning unit 6 is detached from the plurality of display units and located at a place readily observable from the driver. It operates in cooperation with the actuation of one or more than one of display units 5. In case that a lamp, for example, is used as the main warning unit 6, the lamp is preferably flashed at a predetermined interval. Numeral 7 designates a checking unit. A warning apparatus, of course, must always keep the normal state by itself. For example, when lamps are used as the display units 5 and the main warning unit 6, extinguishment due to the breakage of filaments of lamp, troubles of the sensors 1 and the breakage of wiring interconnecting respective or different components should be checked prior to the operation. The checking unit 7 is adapted to check the presence of abnormality in the whole central warning apparatus including electrical wirings, by delivering to the discriminating circuits 2 during a predetermined period, a checking pulse which is generated by a trigger signal caused by, for example, turning the engine key to ON.

Figure 2:
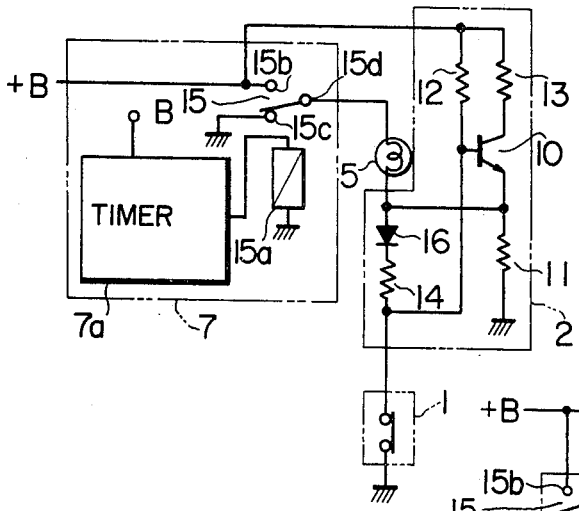
FIG. 2 is a partial circuit diagram of the central warning apparatus of the invention.

The above components will be described with reference to FIG. 2 in which a serial relation between the sensor 1, discriminator circuit 2, display unit 5 and checking unit 7 is illustrated. The sensor 1 which is switched in response to a state of the portion to be inspected is brought into closure as shown in FIG. 2 when the state is normal, but open when the state is abnormal. One end of the sensor 1 is grounded and the other is applied with a voltage + B through a protecting resistor 12 by means of a positive polarity electrode of a battery (not shown but its negative polarity electrode is grounded). The protecting resistor 12 suppresses a current coming into the sensor 1 upon closure thereof in order to protect contacts of the sensor. A n-p-n transistor is connected through a protecting resistor 13 for the display unit 5 (lamp) to the power source + B at its collector and its emitter connected with the display unit 5 is grounded through a resistor 11 and a movable contact 15*d* of the relay 15 closed to a stationary contact 15*c* as shown in FIG. 2. When the sensor 1 is closed, that is when the portion to be inspected is under normal condition, the base of transistor 10 is maintained at ground potential and base-emitter voltage is below threshold so that the transistor 10 is disabled thereby preventing a lamp of display unit to light. When the contact of sensor 1 is opened by detecting an abnormal state of the portion to be inspected, a current from the protecting resistor 12 prevented from flowing into the sensor 1 is blocked by a diode 16 interposed backwardly between the base and emitter of the transistor 10. Thus, the current flows through the base and emitter of transistor 10, thereby bringing it to a conductive state. Then, a circuit through power source + B, lamp protecting resistor 13, collector-emitter of transistor 10, lamp of display unit 5, contacts 15*d* and 15*c* of relay 15 and ground is established to light the lamp of display unit 5. The checking unit 7 includes a timer 7*a* which receives a trigger signal caused by turning the engine key to ON and which supplies power source + B to an electromagnetic coil 15*a* of the relay 15 for its energization during a predetermined period, for example 5 to 10 seconds. The timer 7a may be realized as a simple time delay circuit utilizing a well-known thermal deformation characteristics of a bimetal or charge or discharge characteristics of CR circuit. Assume now that the electromagnetic coil 15 is energized by an output from the timer 7*a* to close contacts 15*b* and 15*d* in FIG. 2. When the sensor 1 is closed, a circuit through power source + B, contacts 15*b* and 15*d*, lamp of display unit, diode 16, lamp protecting resistor 14, sensor 1 and ground is established thereby to light the lamp of display unit 5. By choosing resistance of the lamp protecting resistor 14 substantially the same as that of resistor 13, the lamp of display unit 5 can be lit at the same brightness regardless of the operation of checking unit 7. Although the transistor 10 is non-conductive owing to closure of the sensor 1, there appears across the emitter resistor 11 a voltage equal to a sum of a forward voltage drop across the diode 15 and a voltage drop across the lamp protecting resistor 14. In some cases where the sensor 1 is opened owing to truely abnormal state of the portion to be inspected, of course, in the event that the sensor 1 is open owing to its trouble while the portion to be inspected is normal and in the event that the breakage or tendency to breakage of wirings between the lamp protecting resistor 14 and one contact of the sensor 1 which is not grounded and between the other contact and ground is caused, a circuit through power source + B, contact 15*b*, lamp of display unit 5, resistor 11 and ground is established. However, when the resistor 11 is designed to have for larger resistance than the lamp of display unit 5, the lamp of display unit 5 is prevented from lighting.

The operation of the circuit shown in FIG. 2 will be summarized as follows:

When the checking unit 7 is not actuated with closure of the contact 15*c*, the lamp of display unit 5 extinguishes with closure of the sensor 1 and it lights with open of the sensor 1 owing to the emitter current of transistor 10 which flows into the lamp; when the checking unit 7 is actuated with closure of the contact 15*b*, the lamp of display unit 5 extinguishes with open of the sensor 1, breakage of filament of the display unit lamp or breakage of wiring to the sensor 1, and it lights with closure of the sensor 1 and under normal condition of the display unit lamp and the wiring, since a current flows into the lamp through the contact 15*b*. In short, by turning the engine switch to ON so as to actuate the checking unit 7 during a predetermined period as previously described, it is possible for a driver to completely check the warning apparatus itself before a vehicle starts to run. The driver judges the warning apparatus to be normal when the lamp of display unit 5 continues to light for such short period and abnormal when the lamp extinguishes. In addition, where the lamp of display unit 5 lights at the termination of the predetermined period, it is judged that the state of the portion inspected by the sensor 1 is abnormal, but where the lamp extinguishes, the state is judged to be normal.

Figure 3:
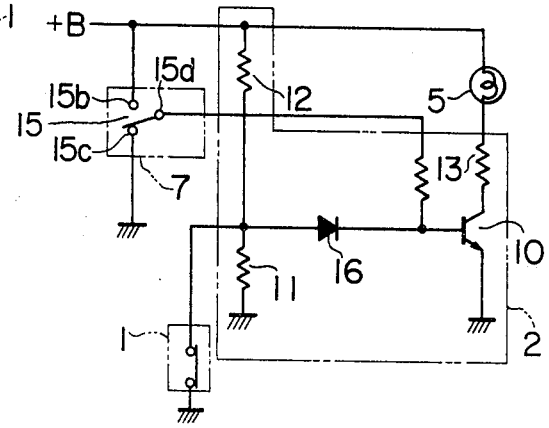
FIG. 3 is a circuit diagram of an alternation of the circuit shown in FIG. 2.

FIG. 3 shows another serial circuit of sensor 1, discriminator circuit 2, display unit 5 and checking unit 7 shown in FIG. 2, which is exchangable therefor. With the circuit arrangement of FIG. 3 which is less complicated than the foregoing circuit, the checking unit designated at 7 can check normality of the display unit 5 but not abnormality of the sensor 1. An operational description of this circuit, which is almost similar to that of FIG. 2, will be described in brief. When the checking unit 7 is not actuated with grounding of the contact 15*d*, the transistor becomes non-conductive with closure of the sensor 1 and the lamp of display unit 5 extinguishes whereas the transistor becomes conductive with open of the sensor 1 and the display unit lamp lights. When the checking unit is actuated with connection of the contact 15*d* to power source + B, the transistor 10 becomes conductive regardless of switching of the sensor 1 and the lamp of display unit 5 lights on. While the checking unit 7 is manually operated in this embodiment, it will be easy for persons skilled in the art to alter the circuit such that the checking unit is incorporated with the timer 7*a* and electromagnetic coil 15*a* so as to be automatically operated by a signal of engine key.

Figure 4:
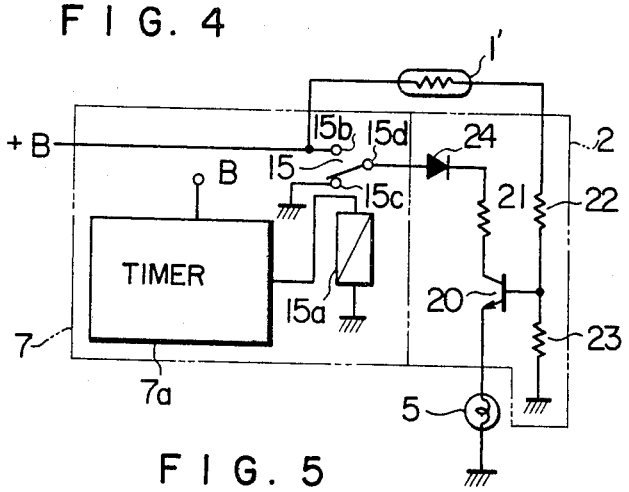
FIG. 4 is a partial circuit diagram of the central warning apparatus of the invention.

Reference is now made to FIG. 4 wherein the sensor of a type which detects the state of the portion to be inspected as an analog quantity is used instead of the sensor 1 which detects it as a binary quantity, that is a normal state or abnormal one as in the foregoing embodiments. A thermistor is preferably used as the sensor because of its decreasing resistance characteristics with a temperature rise, its inexpensiveness and availability. As shown in FIG. 4, the sensor 1′ is a thermistor. Numeral 20 designates an n-p-n transistor with collector connected to the contact 15*d* of relay 15 through the lamp protecting resistor 21 and diode 24, and with emitter connected to the lamp of display unit 5. Resistors 22 and 23 in series to the sensor 1′ are matching resistors for the sensor 1′ and a junction of the resistors 22 and 23 is connected with the base of transistor 20. When the relay 15 is closed to the contact 15c as shown in the figure, the collector of transistor 20 is open-circuited and the transistor 20 serves as a diode between the base and the emitter, thus establishing a circuit through power source +B, sensor 1′, resistor 22, base of transistor 20, emitter of transistor 20, lamp of display unit 5 and ground. By setting the range of resistance of sensor 1′ such that a sufficient amount of current for lighting the lamp is prevented to flow when the state of the portion to be inspected by the sensor 1′ is normal, the lamp of display unit 5 remains extinguished. When the sensor 1′ detects an abnormal state of the portion to be inspected and its resistance falls to a valve low enough to cause the lamp of display unit 5 to light on, for example when an abnormally high temperature in the portion to be inspected is detected or when decrease in flow rate is detected through the heat run phenomenon of thermistor itself, the lighting of the lamp of display unit 5 is indicative of the abnormal state of the portion to be inspected. The matching resistors 22 and 23 for the sensor 1′ are not always needed, but the resistor 23 is effective to assure heat run phenomenon when an intentional use of the heat run phenomenon of thermistor is requested. The operation will be described when the timer 7*a* of checking unit 7 is actuated to transfer the movable contact 15*d* of relay 15 to the stationary contact 15*b*. Regardless of the resistance of the sensor 1′, the base bias current of transistor 20 is supplied through the sensor 1′ and the resistor 22 so that the lamp of display unit 5 lights on with a circuit through power source + B, contact 15*b*, diode 24, lamp protecting resistor 21, collector of transistor 20, emitter of transistor 20, lamp of display unit 5 and ground. By choosing resistance of the resistor 21 nearly equal to that of the sensor 1′ determined by the aforementioned abnormal state of the portion to be inspected, the lamp lights in the same brightness. The breakage of circuit of the sensor 1′, circuit of the display unit lamp and of the lamp itself prevent the lamp of display unit 5 to light. Consequtently, it is possible for the warming apparatus to be checked by itself as described in the embodiment of FIG. 2.

Figure 5:
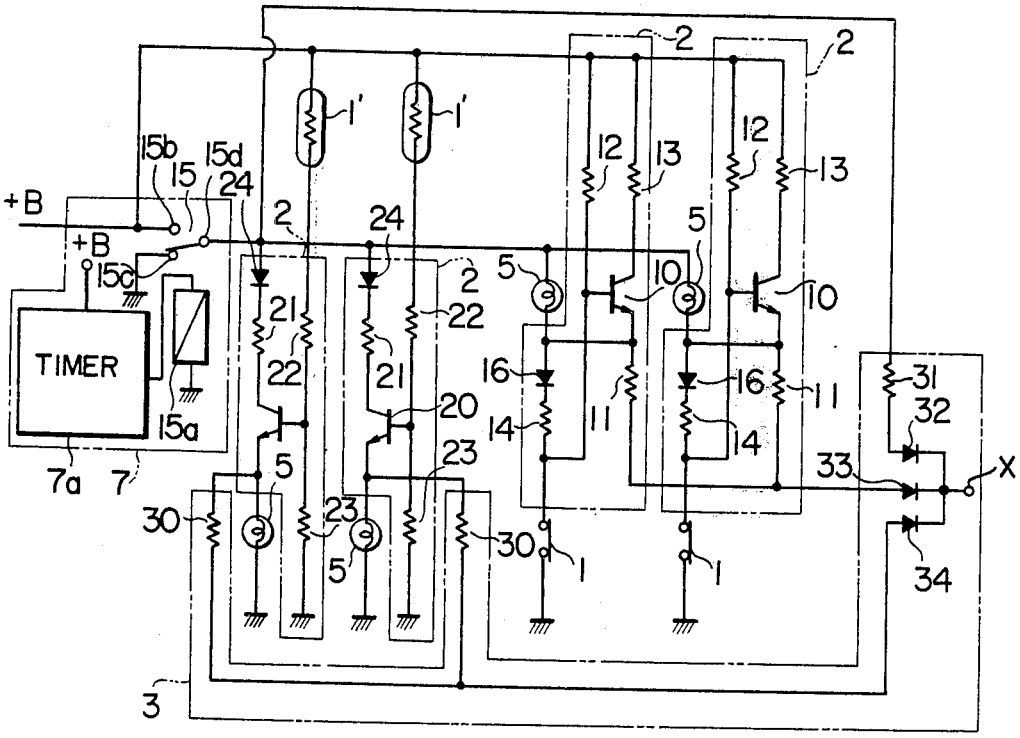
FIG. 5 is a partial circuit diagram of the central warning apparatus of the invention.

A circuit diagram of the OR-gate circuit 3 of FIG. 1 is shown in FIG. 5. Where a plurality of discriminator circuits 2 using the sensor 1, or 1′ shown in FIGS. 2, 3 and 4 are combined and at least one of sensors 1 or 1′ detects an abnormal state of the corresponding portion to be inspected so as to actuate the corresponding discriminator circuit 2 for lighting the lamp of display unit 5, through the use of this OR-gate circuit 3 abnormal signals from respective channels are simultaneously delivered out of a terminal X as output signals and whenever the timer 7*a* is operated, such abnormal output signals are delivered out of the terminal X regardless of the actuation of the discriminator circuit 2. As shown in FIG. 5, two of discriminator circuits 2 shown in FIGS. 2, 3 and 4 are arranged. If more than two of discriminator circuits 2 are used, a similar circuit arrangement will be realized. In order to combine the discriminator circuits each other, the grounding ends of two of resistors 11 as shown in FIG. 2 are disconnected from ground and connected to the anode of a diode 33 in the form of a wired OR-gate. For combination of the discriminator circuits shown in FIG. 4, two resistors 30 are provided each having one end connected to the emitter or respective transistors 20 and the other end connected to the anode of a diode 34 in the form of a wired OR-gate. The anode of a diode 32 is connected to the movable contact 15*a* of relay 15 through a resistor 31. The cathodes of three diodes 32, 33 and 34 are coupled each other to establish the terminal X. For an operational description of this circuit arrangement, assume that a resistor (not shown) is connected between the terminal X and ground. As understood from descriptions of FIGS. 2, 3 and 4, when one of sensors 1 detects an abnormal state under non-actuation of the checking unit 7, the diode 33 is biased forwardly; when one of sensors 1′ detects an abnormal state, the diode 34 is forward-biased. Under actuation of the checking unit 7, the diode 32 is forward-biased. In this manner, the OR-gate circuit 3 delivers from its output terminal X an output for enabling the driving circuit 4 which in turn drives the main warning unit 6 under actuation of the checking unit 7 and it delivers an output for driving the main warning unit 6 under non-actuation of the checking unit 7 when one of sensors 1 or sensors 1′ detects an abnormal state of the portion to be detected. Resistance valves of the resistors 11, 30 and 31 determine the amount of base current where a transistor (not shown) with the base connected to the terminal X is provided.

Figure 6:
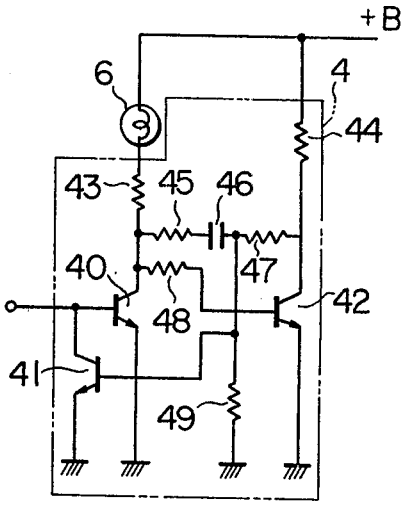
FIG. 6 is a partial circuit diagram of the central warning apparatus of the invention.

FIG. 6 shows a circuit diagram of the driving circuit 4 for main warning unit 6. Symbol X represents a terminal to be coupled to the terminal X shown in FIG. 5. During the presence of a signal at the terminal X shown in FIG. 6, the lamp of main warning unit 6 will flash at a predetermined interval. An n-p-n transistor 40 is loaded with the lamp of main warning unit 6 through a lamp protecting resistor 43. An n-p-n transistor 42 is loaded with a resistor 44. The base of transistor 42 and the collector of transistor 40 are coupled each other through a resistor 48. The collectors of transistors 40 and 42 are coupled each other through a time delay element including a series circuit of resistors 45 and 47 and a capacitor 46. An n-p-n transistor 41 has its collector connected to the base of transistor 40 and its base applied with a divided voltage of the collector-emitter voltage of transistor 42 by means of resistors 47 and 49. In operation, when the diodes 32, 33 and 34 shown in FIG. 5 biased reversely, the transistor 40 is non-conductive and a base current flows into the base of transistor 42 through the lamp of main warning unit 6 and the resistors 43 and 48 thereby to bring the transistor 42 into conductive state. Then, the capacitor 46 is charged such that its electrode connected to the resistor 46 is positively charged as shown in FIG. 6. The resistors 45, 47 and 48 which have for larger resistance values than an internal resistance of the lamp of main warning unit 6 prevent the main warning unit lamp to light. When either one or all of the diodes 32, 33 and 34 are forward-biased, the transistor 40 becomes conductive thereby to light on the lamp of main warning unit 6. At the same time, the transistor 42 is disabled so that a current flows into the capacitor 46 through the resistors 44 and 47 and thus the potential at the electrode of capacitor 46 coupled to the resistor 45 gradually falls to the ground potential. During this process, the base potential of transistor 41 gradually increases and when it exceeds a threshold value, the transistor 41 becomes conductive. Accordingly, even when either one of the diodes 32, 33 and 34 is forward-biased, the transistor 40 is disabled and the lamp of main warning unit 6 extinguishes. Sequentially, the above operation repeats. The ON-OFF period of the transistor 40 is determined by a time constant of a circuit including the resistors 45 and 47 and the capacitor 46.

Now, the present invention will be summarized as follows:

The sensors 1 or sensors 1' are mounted to a plurality of the portions where an abnormal state of parts or units of automobile is inspected for the purpose of delivering an electric output signal responsive to the abnormal state. The electric signal of sensor 1 or 1' is discriminated to judge whether the state of the portion to be inspected is normal or abnormal and when abnormal, the lamp of display unit 5 lights on together with flashing of the lamp of separate main warning unit 6 for a further attention to a driver. The lamp of main warming unit 6 which lights at an extreme brightness is availed effectively. The main warning unit lamp flashes whenever either one of the plurality of portions to be inspected is judged abnormal. Furthermore, the warning apparatus of this invention is of fail-safe. Abnormal state of the system itself, for example breakage of the lamp of display unit 5, trouble of sensor 1 or 1' and breakage of wirings, can be checked before operation of automobile. That is, during a predetermined interval from commencement of engine switch the warning apparatus is checked in such a manner that when all of the display unit lamps for indicating abnormal state of the portions to be inspected light on or when the main warning unit lamp flashes, the warning apparatus is in order.

Figure 7:
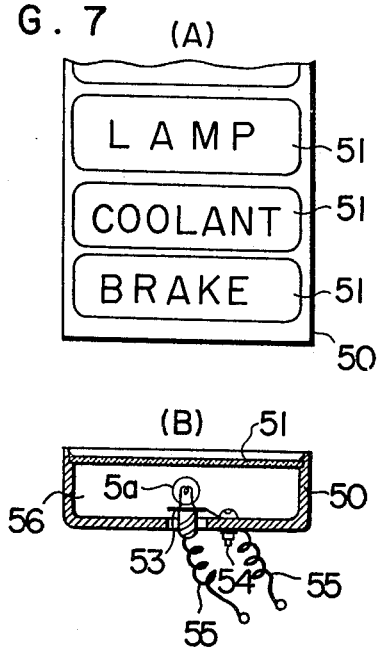
FIG. 7A is a partial plan view of a display unit of the central warning apparatus of the invention.
FIG. 7B is a longitudinal sectional view of the display unit shown in FIG. 7A.

Turning now to FIG. 7, the display unit 5 will be detailed. Preferably, lamps for indicating the abnormal state of portions to be inspected are located collectively at one place. In the figure, numeral 50 designates a lamp housing made of heat-resistant resin which supports a transparent plate 51 made of akryl resin with its front surface printed with names of the portions to be inspected or state thereof as shown in FIG. 7. A lamp *5a* is secured to a screw 54 through a bracket 53 within the housing 50 and applied with an electric current through a lead wire 55. The number of plates 51 responds to that of portions to be inspected and the lamp *5a* is provided for each transparent plate 51. The housing is partitioned to a number of small space 56 in accordance with respective transparent plates 51 for the purpose of prevention of an interaction between light beams from respective lamps. Since the display unit 5 is exclusively used for imminency, it is not necessary to locate the display unit in front of a driver. It is advisable to locate it, for example, on a console box between a driver and an assistant driver or on the front ceiling inside vehicle body.

Contrary thereto, since the lamp of main warning unit 6 is adapted to firstly warn a driver of occurrence of abnormal state at any of portions to be inspected, it is necessary to locate it at a place readily observable from the driver. It is advisable to locate on a meter panel the main warning unit lamp provided with a color lens in red or to illuminate in red by means of the main warning unit lamp on the entire glass surface which covers a speed meter.

Figure 8:
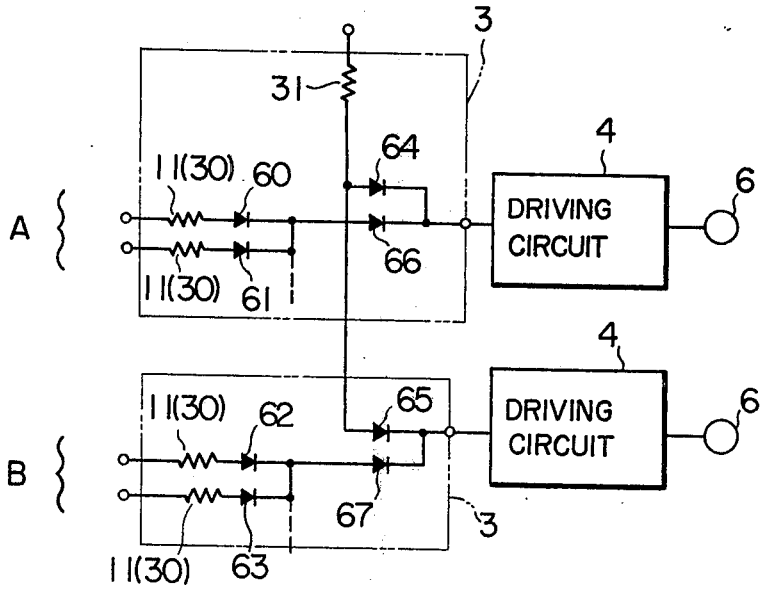
FIG. 8 is a circuit diagram of another embodiment of the invention.

While in the foregoing embodiments the lamp of main warning unit 6 is designed to light on in response to occurrence of abnormal state of any portions to be inspected, it is necessary for the main warning unit lamp to be lit in accoreance with a hierarchy of safety-running as the number of portions to be inspected becomes greater. For example, for portions whose abnormal state is so imminent that an accident will be caused, it is advisable to provide the portion with a main warning unit lamp which illuminates in red; for portions whose abnormal state is not so imminent, it is advisable to provide the portion with a main warning unit lamp which illuminates in orange. A circuit arrangement for this purpose including the OR-gate 3, the driving circuit for actuating the main warning unit 6 will be shown in FIG. 8. In the figure, resistors 11, 30 and 31 are identical with those shown in FIG. 5, and diodes 60 to 67 constitute OR-gates. An abnormal signal from the portions of the high hierarchy is applied to a channel A so as to be gated by the diodes 60 and 61, whereas a relatively low hierarchy abnormal signal to a channel B so as to be gated by the diodes 62 and 63; in addition, signals under actuation of the checking unit 7 are cooperated with the diodes 64 and 66 diodes 65 and 67, respectively, and conducted to separate input terminals of independent driving circuits 4 for actuating main warning unit 6. In this manner, an abnormal signal from the portions of the high hierarchy and that from the portions of the low hierarchy are separately processed through the channels A and B to light two independent lamps of main warning unit 6.

As has been described, in the central warning apparatus of the present invention, there are provided a plurality sensors for the plurality portions to be inspected and when any one of sensors detects an abnormal state of the portion to be inspected, the main warning unit warns a driver of occurrence of the abnormal state and the abnormally stated portion is immediately informed of the occurrence of the abnormal state even when the number of the portions to be inspected increases. Further, a driver is freed from continuous terrible attention to the occurrence of abnormal state of the portions to be inspected and allowed to concentrate on the safety-operation. Moreover, since the whole of warning apparatus can be checked and confirmed by the checking unit in an extremely simple manner, reliability of the warning apparatus can be extremely improved.

What is claimed is:

1. A central warning apparatus for vehicles comprising:

a plurality of sensors each mounted on a vehicle portion to be inspected and adapted to be shifted to a normal state when the portion is in a normal state and to an abnormal operation state when the portion is in an abnormal state, display means provided in correspondence with each said sensor for providing an output signal indicating abnormality of the respective portions to be inspected, checking means connected to said display means for selectively operating said display means so as to check the states of operation of said display means and said sensors, a plurality of discriminator circuits each connected between one of said sensors and said display means and to said checking means for producing an output signal to operate said display means when one of said sensors is in an abnormal state and for operating said display means, in a checking mode of operation, only when a respective series circuit consisting of said display means, said discriminator circuit and said sensor is formed, an OR-gate circuit connected to a plurality of said display means for generating an output signal in response to at least one output signal of one of said plurality of discriminator circuits, and a main warning circuit means connected to said OR-gate circuit for indicating abnormality of at least one of the plurality of portions to be inspected in response to an output signal of said OR-gate circuit.

2. A central warning apparatus for vehicles comprising:

a plurality of sensors each mounted on a vehicle portion to be inspected and adapted to change resistance values thereof in response to changes from normal to abnormal states of the portions, display means provided in correspondence with said sensors for providing an output signal indicating abnormality of the respective portions to be inspected, checking means for selectively operating said display means for checking the states of operation of said display means and said sensors, a plurality of discriminator circuits each connected between one of said sensors and said display means and to said checking means for turning said display means into an ON or OFF state of operation in response to change of resistance values of said sensors and operating said display means, in a checking mode of operation, only when a respective series circuit consisting of said display means, said discriminator circuit and said sensor is formed, an OR-gate circuit connected to a plurality of said display means for generating an output signal in response to at least one output signal of said plurality of discriminator circuits, and a main warning circuit means connected to said OR-gate circuit for indicating abnormality of at least one of the plurality of portions to be inspected in response to an output signal of said OR-gate circuit.

3. A central warning apparatus for vehicles according to claim 1 wherein said checking means comprises a timer for operating said checking means for a certain period of time.

4. A central warning apparatus for vehicles according to claim 2, wherein said checking means comprises a timer for operating said checking means for a certain period of time.

5. A central warning apparatus for vehicles according to claim 1, wherein said discriminator circuits are arranged such that load resistance values of said discriminator circuits when said display means are operated in the abnormal state of said sensors are selected substantially equal to load resistance values of said discriminator circuits when said display means are operated by said checking means.

6. A central warning apparatus for vehicles according to claim 2, wherein resistance values of said sensors are decreased when said sensors detect abnormality of the portions to be inspected.

7. A central warning apparatus for vehicles according to claim 6, wherein in said discriminator circuits, resistance values of said sensors when they are decreased to operate said display means are selected substantially equal to load resistance values of said discriminator circuits when said display means are operated by said checking means.

8. A central warning apparatus for vehicles according to claim 1, wherein each said discriminator circuit comprises an NPN transistor, the base of which is connected through a load resistor to a positive side of an electric source and connected to one of said sensors, the collector of which is connected through a load resistor to the positive side of the electric source, and the emitter of which is connected to said display means, said display means being connected through a load resistor to said one sensor, and said transistor being turned to an ON-state to operate said display means when said one sensor is in an OFF-state, and wherein said checking means checks the operability of said display means and said sensors by selectively connecting said display means which are ordinarily connected to a negative side of said electric source to the positive side of said electric source.

9. A central warning apparatus for vehicles according to claim 6, wherein each said discriminator circuit comprises an NPN transistor the base of which is connected through one of said sensors to a positive side of an electric source, the emitter of which is connected to said display means and the collector of which is connected through a load resistor and a diode to a negative side of the electric source, said transistor being operable as a diode formed by the base and the emitter of said transistor to operate said display means when the resistance value of said one sensor decreases until an abnormality detecting level, and wherein said checking means checks the operability of said display means and said sensors by selectively connecting the collectors of said transistors which are ordinarily connected to the negative side of said electric source to the positive side of said electric source so that an electric conductive path is formed between the base and the emitter of said transistor.

10. A central warning apparatus for vehicles according to claim 3, further including a power switch connected to said timer for operating said timer.

11. A central warning apparatus for vehicles comprising:

a plurality of condition sensors each mounted on a portion of the vehicle to be inspected and providing a first electrical output signal when a normal state is detected and a second electrical output signal when an abnormal state is detected, display means associated with each of said sensors for indicating an abnormal condition in response to production of said second electrical signal by the associated sensor, checking circuit means for operation to provide a check signal, discriminator circuit means connecting each of said sensors and said checking circuit to said display means so that one of said display means indicates an abnormal condition when a second output signal is produced by the associated sensor and so that each sensor is serially connected with said checking circuit means to cause the associated display means to produce an abnormal condition indication when that sensor is producing said first signal and said checking circuit means is operated, an OR-gate circuit connected to a plurality of said display means for producing an output signal when at least one of said display means is producing an abnormal indication, and main warning circuit means for indicating an abnormality warning whenever said OR-gate circuit produces its output signal.

* * * * *

UNITED STATES PATENT OFFICE

CERTIFICATE OF CORRECTION

Patent No. 3,944,969 Dated March 16, 1976

Inventor(s) Hiroshi Arai et al.

It is certified that error appears in the above-identified patent and that said Letters Patent are hereby corrected as shown below:

Claim 1, line 5, after "normal", first occurrence, insert -- operation --.

Signed and Sealed this

Fourteenth Day of December 1976

[SEAL]

*Attest:*

RUTH C. MASON
*Attesting Officer*

C. MARSHALL DANN
*Commissioner of Patents and Trademarks*